United States Patent [19]

Henkel

[11] 4,208,980

[45] Jun. 24, 1980

[54] HYDROFOIL BOAT

[76] Inventor: Henry Henkel, 430 E. 63rd St., New York, N.Y. 10021

[21] Appl. No.: 929,463

[22] Filed: Jul. 31, 1978

Related U.S. Application Data

[63] Continuation of Ser. No. 733,688, Oct. 18, 1976, abandoned, which is a continuation-in-part of Ser. No. 566,155, Apr. 8, 1975, abandoned.

[51] Int. Cl.[2] ..... B63B 1/24

[52] U.S. Cl. ..... 114/274

[58] Field of Search ..... 114/271, 272, 274, 275, 114/276–284

[56] References Cited

U.S. PATENT DOCUMENTS

| | | | |
|---|---|---|---|
| 1,728,937 | 9/1929 | Kemp | 114/274 |
| 2,597,048 | 5/1952 | Almquist et al. | 114/274 |
| 2,709,979 | 6/1955 | Bush et al. | 114/277 |
| 3,092,062 | 6/1963 | Savitsky | 114/277 |
| 3,137,260 | 6/1964 | Harris, Jr. et al. | 114/275 |
| 3,146,751 | 9/1964 | Von Scherter | 114/278 |
| 3,221,698 | 12/1965 | Turner | 114/278 |
| 3,318,405 | 5/1967 | Cockerell | 114/281 |
| 3,998,176 | 12/1976 | Stout et al. | 114/283 |

*Primary Examiner*—Trygve M. Blix
*Assistant Examiner*—Jesus D. Sotelo
*Attorney, Agent, or Firm*—Victor F. Volk

[57] ABSTRACT

A boat outfitted with three hydrofoils disposed, e.g. in a triangular array. At least one of the hydrofoils are provided with an elevator, and the hydrofoils are spaced from the hull by supports therefor. The hydrofoils define the lowermost periphery of the boat and have a flat or substantially flat lower surface so that the boat can be beached on the hydrofoils.

19 Claims, 11 Drawing Figures

HYDROFOIL BOAT

This application is a continuation of Ser. No. 733,688, filed Oct. 18, 1976, which is a continuation-in-part of application Ser. No. 566,155, filed Apr. 8, 1975 both now abandoned.

BACKGROUND

Hydrofoil boats of such construction that the boat can be beached on the hydrofoils, are disclosed in my U.S. Pat. No. 3,802,368. The instant invention is directed to a boat as is the subject of and having the advantages of the boats of the patent while at the same time being of less expensive construction and amenable to application to small boats, e.g. boats of about 18–24 feet in overall length.

As is described in more detail below, the instant boat has three hydrofoils. I am aware of proposals of boats loutfitted with three hydrofoils as in U.S. Pat. Nos. Turner, 3,221,698, Almquist 2,597,048 and Savitsky 3,092,062. In those constructions the hydrofoils are relatively large in widths and short in length. In my instant design the hydrofoils are elongated in the sense that the foil length or longitudinal dimension (i.e. the dimension generally parallel to the longitudinal dimension of the boat) exceeds, preferably substantially exceeds, the width.

EMBODIMENTS

Preferred embodiments of the invention are indicated in the drawings, wherein.

Figure 1:
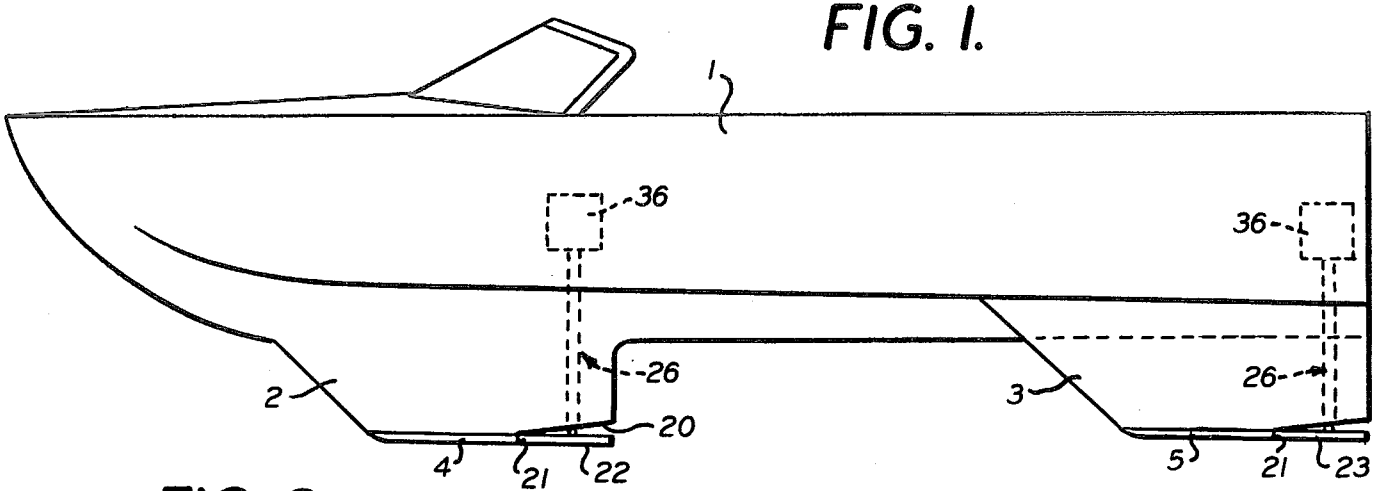
FIG. 1 is a side elevation view of a boat outfitted with hydrofoils according to the invention.
Figure 3:
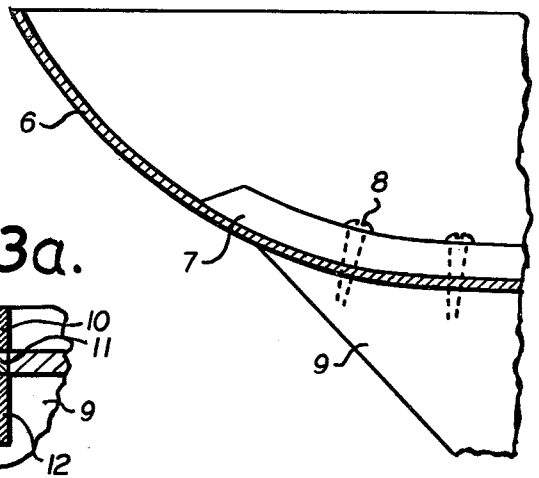
Figure 3A:
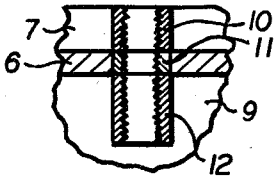
Figure 2:
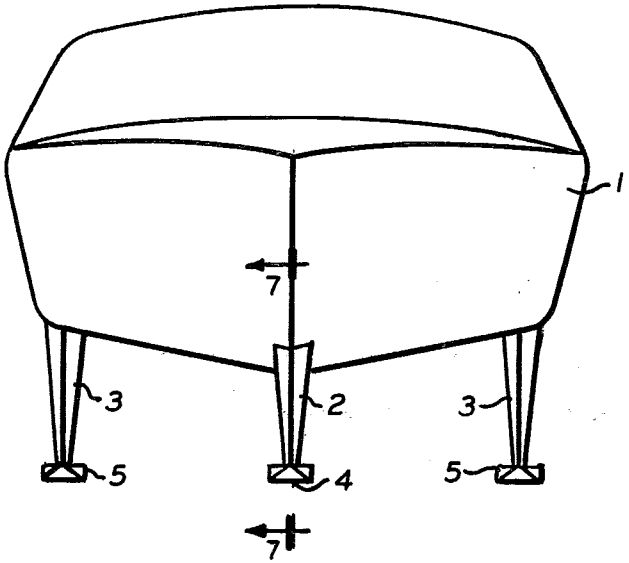
FIG. 2 is a front elevation view of the boat shown in FIG. 1.
Figure 4:
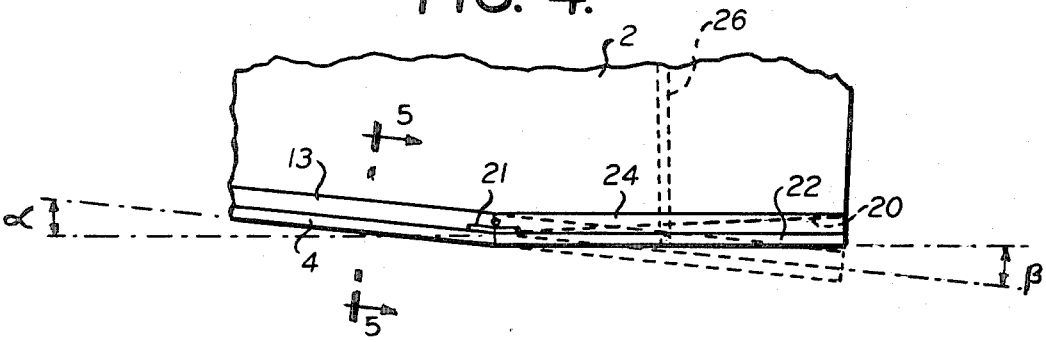
Figure 5:
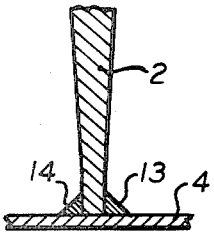
Figure 6:
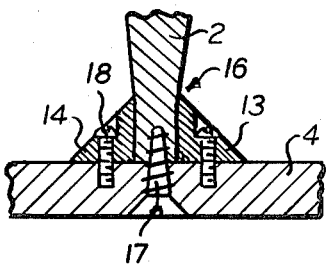
Figure 7:
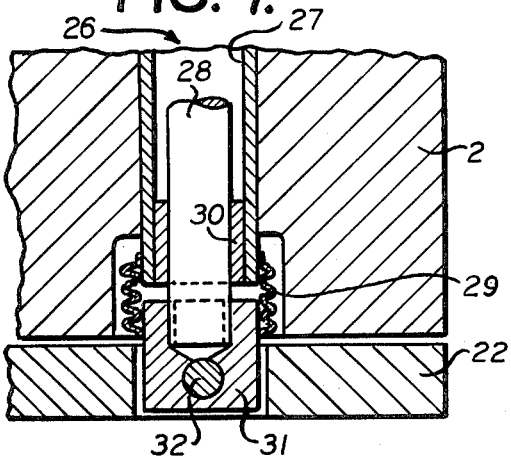
Figure 8:
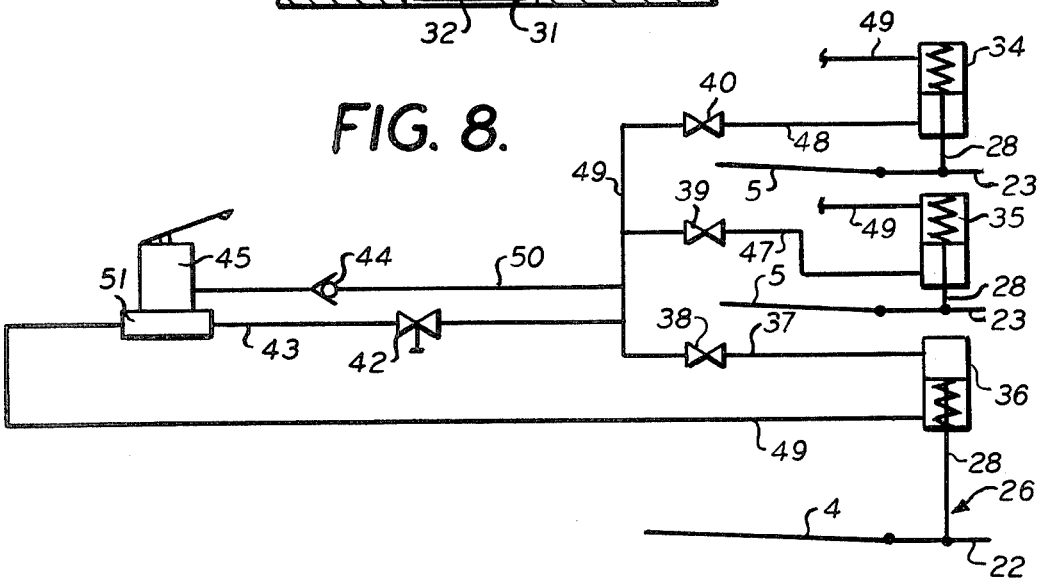
Figure 9:
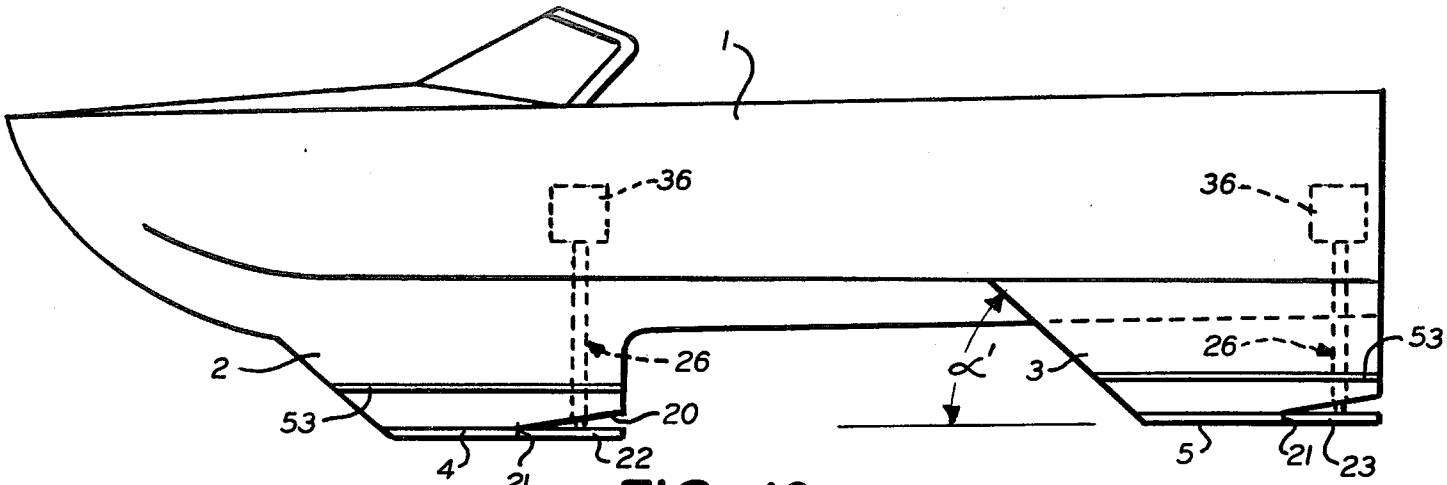
Figure 10:
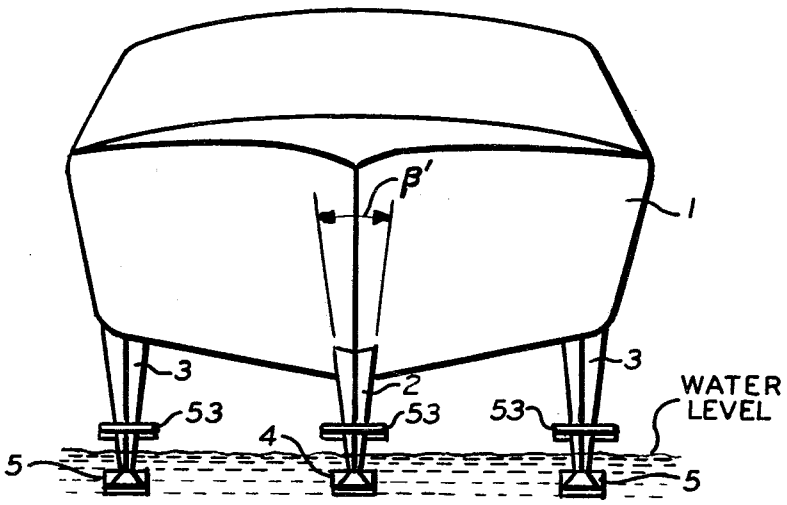

FIG. 3 and 3*a* are sectional views of a hull outfitted with a support for a hydrofoil according to a preferred embodiment of the invention;

FIG. 4 is an enlarged view of a portion of the forward support-hydrofoil assembly shown in FIG. 1;

FIG. 5 is a cross-sectional view taken on line 5—5 in FIG. 4;

FIG. 6 is an enlarged, detailed view of construction indicated in FIG. 5;

FIG. 7 is a side cross-sectional view of the elevator control linkage, taken along line 7—7 in FIG. 2;

FIG. 8 is a flow diagram for a hydraulic control system for the elevators; and FIG. 9 and FIG. 10 correspond with FIG. 1 and FIG. 2, and illustrate a modified construction.

Referring to the drawings, a boat 1, constructed for an outboard motor, of conventional hull design is provided with support 2 at the bow, having hydrofoil 4 mounted on the bottom thereof, and, at the stern, supports 3 for hydrofoils 5. The hydrofoils are provided with elevators, the hydrofoil 4 being provided with elevator 22, and the hydrofoils 5 are provided with elevators 23.

Details of the mounting of the hydrofoils and elevators on the supports are shown in FIGS. 4–6. The elevator 22 is mounted on the hydrofoil 4 by piano hinge 21. In an alternative embodiment, the hydrofoil 4 and elevator 22 can be formed of one piece of suitable plastic which is provided with a crease or creases to provide a narrowed section at the location where the elevator is to pivot with respect to the hydrofoil, the plastic being of such material that it can withstand the flexing.

Referring to FIG. 6, the hydrofoil 4 is secured to the support 2 by screws 17. Triangular strips 13 and 14 are secured by screws 18 to the hydrofoil 4, strengthening the hydrofoil. Further, the triangular strips 13 and 14 provide bracing and strengthening of the connection between the support 2 and the hydrofoil 4, as the fit between the triangular strips and the support, indicated by the reference character 16 can be a tight fit. The elevator 22, as shown in FIG. 4, can be supported, similarly, with triangular strips 24. For the elevator, the triangular strips, are spaced so that the slot provided thereby, i.e. between the strips, permits the elevator to be moved so that, when moved upwardly, the slot receives the lower edge portion 20 of the support 2, at the aft end of the support. The fit between the triangular strips 24 and the lower portion of the support in the location of support lower edge 20, should be such that whereas the desired relative movement is realized, yet the triangular strip provides some bracing for the trailing end portion of the support 2.

The hydrofoil 4, and the hydrofoils 5, referring to FIG. 4, are inclined downwardly toward the stern at an angle $\alpha$. Preferably, $\alpha$ is about 3°–6°. The throw of the elevator (down for 22; up for 23, 23) can be an angle $\beta$, which is preferably about 6° from alignment with the hydrofoil. Desirably, as shown in FIG. 2, the bottom surface of the forward end of each hydrofoil, and especially the forward hydrofoil or hydrofoils, is inclined upwardly and the side surface of each hydrofoil tapers to a point. Thereby beaching is facilitated.

The control linkage for the elevators is indicated in FIG. 7, which shows the control linkage for forward elevator 22. Connecting rod 28, which depends from a hydraulic cylinder, shortly to be described, is threaded into clevis 31, which is connected by pin 32 to elevator 22, so that an up and down movement of the connecting rod 28 serves to pivot the elevator 22 on its hinge connection 21 (FIG. 4) to hydrofoil 4. Assemblage 26 is provided for the interconnection between the elevator 22 and the hydraulic cylinders. A tube 27 provides a housing for the connecting rod 28. A water-tight fit between the housing 27 and the connecting rod 28 is provided by sleeve bearing 30 in which the connecting rod can slide. Similar sleeve bearings can be provided at spaced intervals along the length of the connecting rod 28 to provide suitable strengthening, and the connection of the housing at the hull of the boat is such that the housing is water-tight. Bellows 29 are provided to provide a water-right connection between the housing 27 and the clevis 31. The bellows can be of rubber.

A feature of the invention is the simplicity thereof and the inexpensive construction whereby small boats can be outfitted with a hydrofoil system. Desirably, the supports and hydrofoils are provided so that a boat can, at the option of the owner, be outfitted with the supports and hydrofoils. Such a construction is shown in FIG. 3, wherein the support 9 or the forward hydrofoil is secured to the hull 6 by screws 8 which pass first through backup strip 7 which provides suitable strengthening of the hull 6 for the accommodation of the support-hydrofoil systems.

Desirably, instead of tapered screws as shown in FIG. 3, screws or bolts of uniform diameter along the shank, can be used, and the backup member 7, the hull 6, and support 9, are, as illustrated in FIG. 3*a*, each provided with a threaded sleeve, respectively 10, 11 and 12, for receiving the screw. Such construction permits for convenient assembly to outfit the boat with the hydrofoils, and convenient disassembly to remove the hydrofoils so that the boat can be used in the usual manner. Upon removal of the hydrofoils, the threaded sleeves 11 in the hull 6, would, of course, be closed with suitable, e.g. threaded, plugs.

The elevators can be controlled by any suitable means, e.g. a hydraulic system or electric gear motors. A preferred system is the hydraulic system indicated in FIG. 8. Therein, the hydrofoil-elevator assemblies are shown.

Connecting rods 28 form piston rods of the spring loaded piston-cylinder arrangements 34, 35, 36. Feed lines 37, 47, 48 connect with piston-cylinder arrangements on the feed sides of the pistons, and return lines 49 connect with the other side of the pistons, which are spring loaded on the return sides, whereby the piston 36 is urged upwardly and pistons 34, 35 are urged downwardly. Pump 45 is provided for pumping the control fluid to the cylinders. The hand pump 45 delivers the fluid under pressure to line 50, which is outfitted with a check valve 44, provided to permit flow only from the pump 45 to the feed line 50 and arrest flow in the opposite direction. Feed line 50 connects with manifold 49 which leads to feed lines 37, 47, and 48. Upon actuation of the pump 45 to pump fluid into line 50, the elevators are each adjusted as is desired with forward elevator 22 and aft elevators 23 being raised, all to raise the boat in the water. The hand pump activates all cylinders at the same time. Upon interrupting the operation of pump 45, the elevators become fixed in position, as the pistons are balanced by the springs or locked in place by a check valve or valves, and the pressure of the fluid on the opposite side of the piston. To permit movement of the elevators in the opposite directions, throttle valve 42 is actuated to permit flow of control fluid to the reservoir 51 via line 43. Under influence of the pressure of the springs of the piston-cyclinder assemblies, the fluid is drawn from the reservoir through lines 49.

Valves 38, 39, and 40 are provided, respectively, in lines 37, 47, and 48, to permit adjustment of the relative positions of the various pistons. Thus, if it is desired to adjust the position of the piston of piston-cylinder arrangement 36, relative to the positions of the other pistons, then valves 39 and 40 are closed to isolate piston-cylinder arrangement 36. Pump 45 or valve 42 is then actuated, in order to, respectively, either pump more fluid into the feed side of piston-cylinder arrangement 36 to lower the piston, or to permit fluid to flow from the feed side through line 43 to the reservoir, to raise the piston. This permits adjusting to allow for an unbalanced load.

Desirably, each of the three hydrofoils is provided with an elevator. However, only the forward foil, or only the two aft foils can be outfitted with the elevators.

FIG. 9 and FIG. 10 show a modified construction in which an intermediately disposed hydrofoil is mounted on each strut. Thus struts 3 are outfitted with intermediate hydrofoils 53 and strut 2 is outfitted with intermediate hydrofoil 53. In the embodiment illustrated intermediate hydrofoils are not provided with elevators, and are somewhat wider than the lower hydrofoils. This construction provides increased lift at low speeds. Desirably, at cruising speed the intermediate hydrofoils ride above the water level as is shown in FIG. 10.

While the invention particularly contemplates the use of three and only three hydrofoils, one centrally disposed at the bow and two disposed in transversely spaced relation at the stern, different numbers and different arrays of the hydrofoils can be utilized.

Normally hydrofoils are not associated with small craft—small craft being defined as boats either powered by outboard motors or by inboard-outboard type motors. Since hydrofoils are principally thought of for use in large, high powered boats and military craft, no thought has been directed to designing a boat with a beaching capability. Basically, hydrofoils are supported by hydrofoil struts which are long and slender. They are not intended for use on boats navigating shallow waters or subjected to beaching operations.

My invention provides a small craft with the ability of speed performance in smooth waters and waters with moderate wave patterns. Further, and this feature distinguishes my boat from all others, it has the designed capability of coping with underwater obstacles in shallow waters and also the capability of being beached. My hydrofoil unit has been designed to be completely opposite of the normal hydrofoil. It is narrow and long. The hydrofoils are designed to present minimum frontal area to any underwater obstacles encountered while beaching or negotiating shallow waters.

The length of each hydrofoil is proportionate to the size of the craft and normally will be about 20–35%, preferably about 25%, of the boat length. The hydrofoil strut, at the boat body, will be considerably longer because of the strut's frontal slant, i.e. the slant angle $\alpha'$ in FIG. 9, which can be about 20°–45°. Thus, each strut tapers from its bow end to the hull at an acute angle $\alpha'$ of 20°–45°. The foil width will normally be about 5 to 15%, preferably about 10 to 12% of the length of the hydrofoil.

Imposing a minimum width on the hydrofoil required that the longitudinal length be increased to obtain the required area for lifting the craft out of the water. This correlated with the need to make the water line length of the hydrofoil strut as long as possible for strength purposes. In addition to substantially increasing the length of the hydrofoil, the front edge of the hydrofoil strut was slanted at an angle $\alpha'$ to provide the craft with an obstacle ride-over capability. The slant angle varies between 20° and 45° depending upon the length of the boat. The slant blends both with the forward end of the boat and the forward end of the hydrofoil. A transitional curve of the frontal edge of the hydrofoil strut precludes any sharp edge which could impede riding over any underwater obstacles with the hydrofoil.

The narrow and curved entry of the hydrofoil when combined with the narrow design of the foil itself, provides the craft with the ability to veer and thus tilt slightly while in in the process of passing around underwater obstacles. The front of each hydrofoil is preferably pointed and curved to provide a smooth transition from a front force to a lateral thrust.

The hydrofoil width multiplied by its length determines the lift area which partly determines the lifting force at each hydrofoil. Other factors, as indicated in the formula below, are the angle of incidence of the hydrofoils, the lift coefficient and the boat velocity.

$$L = CL\rho A\ V2/2$$

Where

CL = lift coef. (varies with angle of incidence)

$\rho$ = density of water in slugs/Ft$^3$

A = area of hydrofoil

V = velocity of boat in ft/sec.

One important point of my invention, which cannot be stressed too much, is that while the boat height above the water-line is determined by the angle of the boat elevators, any upward force required to cope with minor wave patterns is provided with the buoyant effect of the large hydrofoil struts. In other words, there is no wave sensor or complicated system of electric or hydraulic servo motors to constantly control the boat height above the water-line. Since the hydrofoil is intended for small craft usage and the rough handling associated with beaching and negotiating shallow waters, the system has been made as simple as possible.

The hydrofoil struts are deliberately designed to be much larger at the point where they join the boat body than at the hydrofoil. This was done both for strength purposes and to obtain the additional buoyancy needed when the craft is encountering wave patterns. From simple strength formulas, it can be determined that the greatest stress on a cantiliver beam is at the point where it is supported. Any lateral thrust on the side of the hydrofoil can be considered comparable to this cantilever action. The point of highest stress is the hydrofoil strut juncture with the boat hull. Therefore, the hydrofoil strut is widest at this junction. The strut angle, by which is meant, the vertically disposed angle enclosed by the upwardly extending sides of the struts ($\beta'$ in FIG. 10) can be 5°–15°, preferably 7°–12°, with each of said sides being disposed at about the same angle from the vertical.

With the encounter of wave patterns, the upward force imparted to the hydrofoils because of the buoyancy of the hydrofoil struts, will be sufficient to eliminate any bouncing action of a small craft without this hydrofoil system.

A true hydrofoil boat with slender struts and an automatic height sensor and servo mechanisms would have the built-in capability coping with wave patterns.

My system provides for a much simpler automatic response system because of the special configuration of the hydrofoil struts and their built-in buoyancy capability.

The design of the elevator was in large part determined by the requirement that the craft be provided with narrow hydrofoils. Narrow in the sense that the width of the hydrofoil unit is less than its length. In fact, the drawing shows the width to be approximately $\frac{1}{8}$ that of the length. In general, prior art proposals do not show the width of the hydrofoil to be less than its length. Herein width refers to the width of individual hydrofoils.

To cope with the need for narrow foils, it proved to be necessary to make the elevator fairly long in proportion to the stationary hydrofoil. The effect of the actuation of a flap is quite different from actuation of flaps on wide hydrofoils. Herein, a slight inclination has a marked effect on the lifting capability. For my design, I selected an elevator length, i.e. the length over which the angle of incidence is varied, of 35–60%, preferably about 45–55 %, better, about one half of the overall hydrofoil length. Normally, this approach would not be adopted for hydrofoils as the amount of power required to move $\frac{1}{2}$ the hydrofoil is considerable. However, since my hydrofoil design differs from the extent that power is applied only to the extent of moving the foil to achieve the desired boat elevation above water, this can be tolerated. From that point on, the natural buoyancy imparted by the hydrofoil struts takes over to take care of coping with moderate wave patterns.

Lengthening of the foil made it possible to cope with the heavy vertical loads imposed upon the bottom of the hydrofoils in beaching operation. The short hydrofoils of prior art constructions would not withstand beaching forces or would become quickly worn and abused in such operations. Lengthening the foils to the extent indicated in my hydrofoil serves to spread the load over a much larger area therefore reducing the wear to a minimum.

For beaching, the elevators are best placed in horizontal disposition.

For small craft, boats of 18–24 feet in length, the length of the hydrofoils, including the elevators, can be about 4–6, or, e.g. about 2–3 feet and elevators can be 150, to $\frac{1}{2}$, preferably $\frac{1}{4}$ to $\frac{1}{2}$, and best about $\frac{1}{2}$ the length of the stationary part of the foil. The length of the bow hydrofoil, including the elevator can be somewhat longer than the stern foils, including the stern elevators. As is described above, the angle of inclination of the stationary foils can very depending upon the motor size. The larger the motor, the greater the speed of the boat, and the less the angle of inclination need be.

The forward, centrally disposed hydrofoil is located so that the elevator thereof is forward of the center of gravity, so that the elevator is moved down to raise the boat in the water. The hydrofoils at the stern, are of course, disposed so that the elevators 23 are aft of the center of gravity, and so that the elevators 23 are lowered to raise the boat in the water.

The spacing of the hydrofoils from the bow can be about 2–3 feet. The fore and aft hydrofoils can be spaced from the bow so that they are disposed at about the same level in the water with the boat level in the water. When disposed in the water, the forward, centrally disposed hydrofoil can be at a somewhat higher level, in the water, than the two stern hydrofoils. That construction facilitates beaching.

The supports 2, 3, can be constructed of plywood or plastic, e.g. they can be injection molded, using polyurethane plastic. The foils, both the stationary portion and the elevators, can be stainless steel. While in the embodiments illustrated, the hull is of conventional design, the hydrofoils can be mounted on the tri-hull boats, with a single forward hydrofoil, centrally disposed, and two, and only two, aft hydrofoils, transversely spaced with the supports depending from the outer break lines of the tri-hull.

Outboard motors or inboard-outboard motors are contemplated. Suitable motors with long drive shafts are commercially available. Two motors can be used if desired.

SUMMARY

Thus, the invention provides a hydrofoil boat comprising a hull, and three elongated, transversely and longitudinally extending hydrofoils, spaced from the hull and having exposed lower surfaces. The length of each of the hydrofoils exceeds the width and the hydrofoils are disposed longitudinally of the hull. One of the hydrofoils is disposed centrally at one end of the boat, and the other two are disposed in transversely spaced relation at the other end of the boat. An elevator is hingedly connected to one end of at least one, preferably at least two, and better all three, of said hydrofoils, for controlling the elevation of the boat in the water. Thus, an elevator can be provided on the centrally disposed hydrofoil only, or two elevators can be provided on the two transversely spaced hydrofoils only, or all three hydrofoils can be provided with elevators. Support means for each hydrofoil depend from the hull and support the hydrofoil from the hull in spaced relation with respect thereto. The hydrofoils define the lowermost perphery of the boat in a manner such that the boat can be beached with the hydrofoils in place and so that as beached, the boat rests on the hydrofoils. Means are provided for controlling the position of the elevator or elevators.

Preferably, the centrally disposed hydrofoil is at the bow. The hydrofoils can be inclined downwardly toward the stern at an angle of up to 10°, preferably 0 or 1.5°–8°, and best 3°–6°. Desirably, each of the foils is outfitted with an elevator. The throw of the elevator or elevators can be up to 20° or even more. Preferably, the throw for a forward elevator is from 3° above the horizontal to 10° below the horizontal, and, best, is from the horizontal to about 6° below the horizontal.

The invention particularly contemplates the use of the hydrofoils with small boats, e.g. boats up to 24 feet in length, desirably 12–24, better 18–24. The hydrofoils, can of course, be applied to larger boats, e.g. boats up to 42 feet in length. Further, the invention contemplates that the hydrofoil or supports and hydrofoil can be integrally constructed with the hull, as by molding the supports as part of a molded hull, in a one-piece molding, with the hydrofoils being either similarly molded or secured to the supports with suitable fastening means. However, a feature of the invention is that the hydrofoil construction is such that the supports and hydrofoils can be provided for by mounting on hulls not specially made for the hydrofoils but which are suitably strengthened for hydrofoil operation, or made such that, if desired, the supports and hydrofoils can be attached.

Desirably the support means or struts extend from about the aft end of each hydrofoil to the bow end thereof and taper from the bow end to the hull at an acute angle of 20°–45°. Further, preferably, the struts have upwardly extending sides defining a strut angle of 15° to 20°.

While the invention has been described with particular reference to preferred embodiments thereof, it will, of course, be understood that those embodiments are merely presented as representative of the invention.

What is claimed is:

1. A boat capable of being beached comprising:

(a) a hull, (b) three long, narrow hydrofoils each having the longitudinal dimension thereof disposed in the direction of the longitudinal dimension of the hull, disposed longitudinally of the hull, all points of each of the hydrofoils being spaced substantially downwardly from the hull and having exposed lower surfaces, (c) one of said hydrofoils being disposed centrally at one end of the boat, the other two being disposed in transversely spaced relation at the other end of the boat, (d) an elevator hingedly connected to one end of at least one of said hydrofoils for controlling of elevation of the boat in the water, (e) support means for each hydrofoil depending from the hull and fixedly supporting the hydrofoil connectedly from the hull in spaced relation along substantially the entire fixed length of the hydrofoil, (f) the hydrofoils defining the lowermost periphery of the boat such that the boat can be beached with the hydrofoils in place and so that as beached the boat rests on the hydrofoils, and (g) means for controlling the position of said elevator(s).

2. Boat according to claim 1, the centrally disposed hydrofoil being at the bow.

3. Boat according to claim 2, the hydrofoils being inclined downwardly toward the stern at an angle of about 3°–6°.

4. Boat according to claim 1, the hydrofoils being inclined downwardly toward the stern at an angle of about 3°–6°.

5. Boat according to claim 1, the boat being about 18–24 feet in overall length.

6. Boat according to claim 1, each hydrofoil being outfitted with an elevator.

7. Boat according to claim 6, the length of each hydrofoil being 20–35% of the boat length.

8. Boat according to claim 1, the supports being secured to the boat by releasable fastening means.

9. Boat according to claim 1, the throw of each elevator from alignment with the hydrofoil being about 6°.

10. Boat according to claim 1, the support means (e) comprising a strut extending from about the aft end of each hydrofoil to the bow end thereof and tapering from the bow end to the hull at an acute angle of 120°–45°.

11. Boat according to claim 10, the support means (e) comprising a strut having upwardly extending sides defining a strut angle of 15° to 20°.

12. Boat according to claim 1, the support means (e) comprising a strut having upwardly extending sides defining a strut angle of 15° to 20°.

13. Boat according to claim 1, and an intermediately disposed hydrofoil mounted on each support means.

14. Boat according to claim 13, the intermediate hydrofoils being without elevators.

15. Boat according to claim 1, the length of each hydrofoil being 20–35% of the boat length.

16. Boat according to claim 1, the boat being about 12–24 feet in overall length.

17. Boat according to claim 1, the length of the elevator being 35–60% of the overall hydrofoil length.

18. Boat according to claim 16, the length of each hydrofoil being 20–35% of the boat length.

19. Boat according to claims 15, 16, 17 or 18, the width of each foil being 5 to 15% of the length thereof.

* * * * *